US010745948B2

(12) United States Patent
Cumbo

(10) Patent No.: US 10,745,948 B2
(45) Date of Patent: Aug. 18, 2020

(54) VEHICULAR CLOSURE LATCH ASSEMBLY HAVING DOUBLE PAWL LATCH MECHANISM

(71) Applicant: Magna Closures Inc., Newmarket (CA)

(72) Inventor: Francesco Cumbo, Pisa (IT)

(73) Assignee: MAGNA CLOSURES INC., Newmarket (CA)

( * ) Notice: Subject to any disclaimer, the term of this patent is extended or adjusted under 35 U.S.C. 154(b) by 465 days.

(21) Appl. No.: 15/615,467

(22) Filed: Jun. 6, 2017

(65) Prior Publication Data

US 2017/0350173 A1 Dec. 7, 2017

Related U.S. Application Data

(60) Provisional application No. 62/346,655, filed on Jun. 7, 2016.

(51) Int. Cl.
*E05B 85/26* (2014.01)
*E05B 85/24* (2014.01)

(52) U.S. Cl.
CPC ..... *E05B 85/26* (2013.01); *E05B 85/243* (2013.01); *Y10S 292/23* (2013.01); *Y10T 292/108* (2015.04); *Y10T 292/1043* (2015.04); *Y10T 292/1047* (2015.04); *Y10T 292/1062* (2015.04); *Y10T 292/1082* (2015.04); *Y10T 292/1092* (2015.04)

(58) Field of Classification Search
CPC .. E05B 85/261; E05B 85/243; Y10T 292/108; Y10T 292/1082; Y10T 292/1092; Y10T 292/1047; Y10T 292/1043; Y10T 292/1062; Y10S 292/23
See application file for complete search history.

(56) References Cited

U.S. PATENT DOCUMENTS 4,518,180 A * 5/1985 Kleefeldt ..... E05B 81/06 292/201
4,988,135 A * 1/1991 Ottino ..... E05B 81/20 292/201
5,411,302 A * 5/1995 Shimada ..... E05B 81/14 292/201
5,639,130 A * 6/1997 Rogers, Jr. ..... E05B 81/20 292/199
5,738,393 A * 4/1998 Chao ..... E05B 83/24 292/216
5,802,894 A * 9/1998 Jahrsetz ..... E05B 77/48 292/144
5,938,252 A * 8/1999 Uemura ..... E05B 81/14 292/201

(Continued)

FOREIGN PATENT DOCUMENTS

WO WO2009143997 A 12/2009
WO WO2011094834 A1 8/2011

*Primary Examiner* — Kristina R Fulton
*Assistant Examiner* — Faria F Ahmad
(74) *Attorney, Agent, or Firm* — Dickinson Wright PLLC

(57) ABSTRACT

A door latch assembly equipped with a single ratchet-double pawl latching arrangement having a ratchet, a primary pawl and a secondary pawl. The primary pawl is configured to include a first or primary lug and a second or secondary lug, with each lug having a distinct profile to respectively provide an eccentric backout characteristic and a concentric backout characteristic in relation to the ratchet.

21 Claims, 18 Drawing Sheets

(56) References Cited

U.S. PATENT DOCUMENTS 5,979,951 A * 11/1999 Shimura ..... E05B 85/26 292/216
6,056,334 A * 5/2000 Petzold ..... E05B 81/14 292/201
6,575,003 B1 * 6/2003 Dupont ..... E05B 81/14 292/201
6,575,507 B2 * 6/2003 Reddmann ..... E05B 81/14 292/201
6,773,042 B2 * 8/2004 Spurr ..... E05B 77/02 292/201
8,684,424 B2 * 4/2014 Wattebled ..... E05B 81/20 292/201
8,740,263 B2 6/2014 Singh et al.
8,764,075 B2 7/2014 Taurasi et al.
9,279,277 B2 * 3/2016 Spurr ..... E05B 81/14
9,366,063 B2 * 6/2016 Rosales ..... E05B 85/26
9,512,651 B2 12/2016 Taurasi et al.
9,810,004 B2 * 11/2017 Scholz ..... E05B 81/14
9,874,046 B2 * 1/2018 Wittelsbuerger ..... E05B 77/06
10,012,013 B2 * 7/2018 Scholz ..... E05B 85/26
10,132,109 B2 * 11/2018 Bendel ..... E05B 85/26
10,352,070 B2 * 7/2019 Margheritti ..... E05B 79/20
10,358,846 B2 * 7/2019 Hanaki ..... E05B 85/243
10,358,848 B2 * 7/2019 Scholz ..... E05B 85/26
10,385,592 B2 * 8/2019 Manolescu ..... E05B 79/22
10,415,278 B2 * 9/2019 Choi ..... E05B 85/26
2001/0024040 A1 * 9/2001 Spurr ..... E05B 85/243 292/216
2003/0164616 A1 * 9/2003 Belmond ..... E05B 77/12 292/201
2003/0178858 A1 * 9/2003 Spurr ..... E05B 83/16 292/217
2004/0055407 A1 3/2004 Coleman et al.
2004/0056489 A1 * 3/2004 Boecker ..... E05B 81/14 292/201
2004/0113438 A1 * 6/2004 Kachouh ..... E05B 81/14 292/201
2004/0174021 A1 * 9/2004 Tensing ..... E05B 81/14 292/216
2004/0227358 A1 * 11/2004 Kachouh ..... E05B 81/14 292/216
2005/0140147 A1 * 6/2005 Spurr ..... E05B 85/26 292/216
2005/0167990 A1 * 8/2005 Orzech ..... E05B 81/14 292/201
2005/0212302 A1 * 9/2005 Fisher ..... E05B 81/14 292/216
2006/0006676 A1 * 1/2006 Plett ..... B62D 33/0273 292/300
2006/0012186 A1 * 1/2006 Zillert ..... E05B 81/20 292/216
2006/0028029 A1 * 2/2006 Spurr ..... E05B 81/20 292/216
2006/0055181 A1 * 3/2006 Berghahn ..... E05B 81/20 292/216
2006/0163883 A1 * 7/2006 Hoshikawa ..... E05B 83/36 292/216
2006/0208504 A1 * 9/2006 Kachouh ..... E05B 85/26 292/216
2006/0226661 A1 * 10/2006 Moore ..... E05B 81/20 292/216
2008/0073917 A1 3/2008 Ciavaglia et al.
2008/0217928 A1 * 9/2008 Spurr ..... E05B 81/20 292/198
2008/0224482 A1 9/2008 Cumbo et al.
2009/0322104 A1 * 12/2009 Nam ..... E05B 85/243 292/216
2010/0052336 A1 * 3/2010 Bendel ..... E05B 85/26 292/196
2010/0052341 A1 3/2010 Taurasi et al.
2010/0127511 A1 5/2010 Vasquez et al.
2010/0289274 A1 * 11/2010 Shafry ..... E05B 81/14 292/194
2011/0012376 A1 * 1/2011 Hunt ..... E05B 85/26 292/216
2011/0074166 A1 * 3/2011 Taurasi ..... E05B 81/14 292/27
2011/0169280 A1 * 7/2011 Scholz ..... E05B 85/26 292/200
2011/0169282 A1 * 7/2011 Scholz ..... E05B 85/26 292/220
2011/0187132 A1 * 8/2011 Scholz ..... E05B 81/20 292/226
2011/0204673 A1 8/2011 Cumbo et al.
2011/0210565 A1 * 9/2011 Scholz ..... E05B 85/26 292/200
2012/0068479 A1 * 3/2012 Bendel ..... E05B 81/20 292/200
2012/0175896 A1 * 7/2012 Martinez ..... E05B 81/06 292/199
2012/0181798 A1 * 7/2012 Margheritti ..... E05B 77/32 292/200
2014/0000169 A1 * 1/2014 Yokomori ..... B60J 5/00 49/349
2014/0049056 A1 * 2/2014 Scholz ..... E05B 81/14 292/200
2014/0284942 A1 * 9/2014 Wittelsbuerger ..... E05B 77/06 292/92
2014/0284943 A1 * 9/2014 Wittelsbuerger ..... E05B 77/06 292/92
2014/0284944 A1 * 9/2014 Rosales ..... E05B 77/06 292/113
2014/0346786 A1 * 11/2014 Takagi ..... E05B 77/06 292/200
2015/0076835 A1 * 3/2015 Mitchell ..... E05B 77/38 292/194
2015/0084351 A1 * 3/2015 Scholz ..... E05B 85/26 292/200
2015/0115628 A1 * 4/2015 Wittelsbuerger ... E05B 63/0056 292/200
2015/0159407 A1 * 6/2015 Didier ..... E05B 81/68 292/197
2015/0159408 A1 * 6/2015 Hunt ..... E05B 77/06 292/341.17
2015/0167357 A1 * 6/2015 Nam ..... E05B 85/243 292/200
2015/0233156 A1 * 8/2015 Scholz ..... E05B 85/26 292/200
2015/0240536 A1 * 8/2015 Cumbo ..... E05B 85/20 292/200
2015/0240537 A1 * 8/2015 Cumbo ..... E05B 85/20 292/200
2016/0090759 A1 * 3/2016 Rosales ..... E05B 79/22 292/220

* cited by examiner

VEHICULAR CLOSURE LATCH ASSEMBLY HAVING DOUBLE PAWL LATCH MECHANISM

CROSS-REFERENCE TO RELATED APPLICATIONS

This application claims priority to U.S. Provisional Application No. 62/346,655 filed Jun. 7, 2016. The entire disclosure of the above application is incorporated herein by reference.

FIELD

The present disclosure relates generally to vehicle door latches and, more specifically, to a door latch assembly having a double pawl latch mechanism configured with a primary pawl having two closing notches.

BACKGROUND

This section provides a general summary of background information related to vehicle door latches and the components and examples provided in this section are not necessarily prior art to the inventive concepts and features provided by the present disclosure.

A vehicle closure, such as a door for the passenger compartment of a motor vehicle, is typically hinged to swing between open and closed positions and is equipped with a door latch assembly. The door latch assembly functions in a well-known manner to latch the door when closed, to lock the door in the closed position, and to unlock and unlatch the door when required to permit the door to be opened and swung to its open position.

The door latch assembly can be operated remotely from the exterior of the motor vehicle by at least two distinct operators which typically include a key cylinder that controls operation of a latch mechanism and an outside door handle that controls operation of a release mechanism. Similarly, the door latch assembly can also be operated remotely from inside the passenger compartment by at least two distinct operators which typically include a sill button/pull knob that controls the operation of the latch mechanism and an inside door handle controlling operation of the release mechanism. Modern door latch assemblies commonly include one or more power-operated features, such as power lock and/or power release functionality for controlling operation of the latch mechanism and/or the release mechanism using electric motors which receive control signals from a keyless entry system.

Virtually all door latch assemblies employ a ratchet and pawl type of latch mechanism for releasably engaging and holding a vehicle-mounted striker when the door is in its closed position. Due to door sealing loads, it is known that a rather large release effort may be required to release the pawl from engagement with the ratchet so as to permit the ratchet to subsequently pivot from a striker capture position to a striker release position. As an alternative to single pawl latching systems, some door latch assemblies are equipped with a double pawl latching arrangement which utilize a primary ratchet and pawl set that is operably connected to a secondary ratchet and pawl set. The connection may be configured such that only a portion of the forces experienced by the primary pawl and ratchet set are applied to the secondary pawl and ratchet set, thus requiring only relatively low release efforts to release the latch assembly.

While door latch assemblies of the type noted above operate satisfactorily for their intended purpose, a recognized need exists to develop alternative door latch assemblies that improve upon known configurations in terms of enhanced operation, reduced weight and cost, and optimized packaging. In particular, a need is recognized to advance the art related to double pawl latching systems by simplifying the configuration thereof via reducing the number of moveable components and the complexity of such components.

SUMMARY

This section provides a general summary of the inventive concepts and features associated with double pawl door latch assemblies embodying the teachings of the present disclosure. However, this section is not intended to represent an exhaustive and comprehensive disclosure of the full scope or all the features, objectives, aspects and advantages associated with the present disclosure.

One broad aspect of the present disclosure relates to a latch assembly for a door closure system of the type applicable to motor vehicles that is generally configured to include a single ratchet-double pawl latch mechanism having a ratchet, a primary pawl, a secondary pawl, and a snow-load lever in combination with a latch release mechanism for controlling movement of the primary and secondary pawl during a latch release operation.

It is another aspect of the present disclosure to configure the ratchet to include a primary closing notch and a secondary closing notch and to configure the primary pawl to define a primary lug having an eccentric profile and a secondary lug having a concentric profile, each working respectively in conjunction with the primary and secondary closing notches on the ratchet. The eccentric profile of the primary lug on the primary pawl establishes a neutral backout characteristic in cooperation with the ratchet when the ratchet is located in its secondary striker capture position while the concentric profile of the secondary lug on the primary pawl establishes a negative backout characteristic in cooperation with the ratchet when the ratchet is located in its primary striker capture position.

In accordance with these and other aspects, the present disclosure is directed to a vehicle door latch comprising: a ratchet moveable between a striker release position whereat the ratchet is positioned to receive a striker and primary and secondary striker capture positions whereat the ratchet is positioned to retain the striker, the ratchet being biased toward the striker release position; a ratchet lever coupled for movement with the ratchet and having a ratchet lever activation segment; a primary pawl moveable between an engaged position whereat the primary pawl is positioned to hold the ratchet in one of its primary and secondary striker capture positions and a disengaged position whereat the primary pawl is positioned to permit movement of the ratchet to its striker release position, the primary pawl being biased toward the engaged position; a secondary pawl moveable between an engaged position whereat the secondary pawl is positioned to hold the primary pawl in the engaged position and a disengaged position whereat the secondary pawl is positioned to permit movement of the primary pawl to the disengaged position, the secondary pawl being biased toward the engaged position; and a snow-load lever moveable between a disengaged position whereat the snow-load lever permits movement of the secondary pawl between the engaged and disengaged positions and an engaged position whereat the snow-load lever is positioned to hold the secondary pawl in the disengaged position, the snow-load lever being biased toward the engaged position. The ratchet lever activation segment of the ratchet lever engages and holds the snow-load lever in the disengaged position when the ratchet is located in the primary striker capture position. Movement of the ratchet in a releasing direction from the primary striker capture position causes the ratchet lever activation segment to disengage the snow-load lever and permit the snow-load lever to move from the disengaged position into the engaged position. However, movement of the ratchet in a closing direction from the secondary strike capture position into the primary striker capture position causes the ratchet lever activation segment to engage the snow-load lever and cause the snow-load lever to move from the engaged position into the disengaged position. An eccentric directional force vector is established between the ratchet and the primary pawl when the primary pawl is located in the engaged position and the ratchet is located in the primary striker capture position, and a concentric directional force vector is established between the ratchet and the primary pawl when the primary pawl is located in the engaged position and the ratchet is located in the secondary striker capture position.

In accordance with another aspect, there is provided a vehicle door latch assembly having a latch mechanism. The latch mechanism has a ratchet having a primary closing notch and a secondary notch formed thereon, the ratchet being moveable between a striker release position whereat the ratchet is positioned to receive a striker and primary and secondary striker capture positions whereat the ratchet is positioned to retain the striker. The latch mechanism further has a pawl being moveable between an engaged position whereat the pawl is positioned to hold the ratchet in one of the primary and secondary striker capture positions and a disengaged position whereat the pawl is positioned to permit movement of the ratchet to the striker release position. The pawl has a primary lug formed thereon to engage the primary closing notch when the ratchet is positioned in the primary striker capture position, wherein the primary lug is formed to include an eccentric profile, and a secondary lug formed thereon to engage the secondary closing notch when the ratchet is positioned in the secondary striker capture position, wherein the secondary lug is formed to include a concentric profile. The vehicle door latch assembly also has a latch release mechanism operable for moving the pawl from the engaged position to the disengaged position.

Further areas of applicability will become apparent from the description provided herein. The description and specific examples in this summary are intended for purposes of illustration only and are not intended to limit the scope of the present disclosure.

DRAWINGS

The drawings described herein are intended to illustrate selected embodiments of the present disclosure and are not intended to limit the scope of the present disclosure.

and

Figure 1:
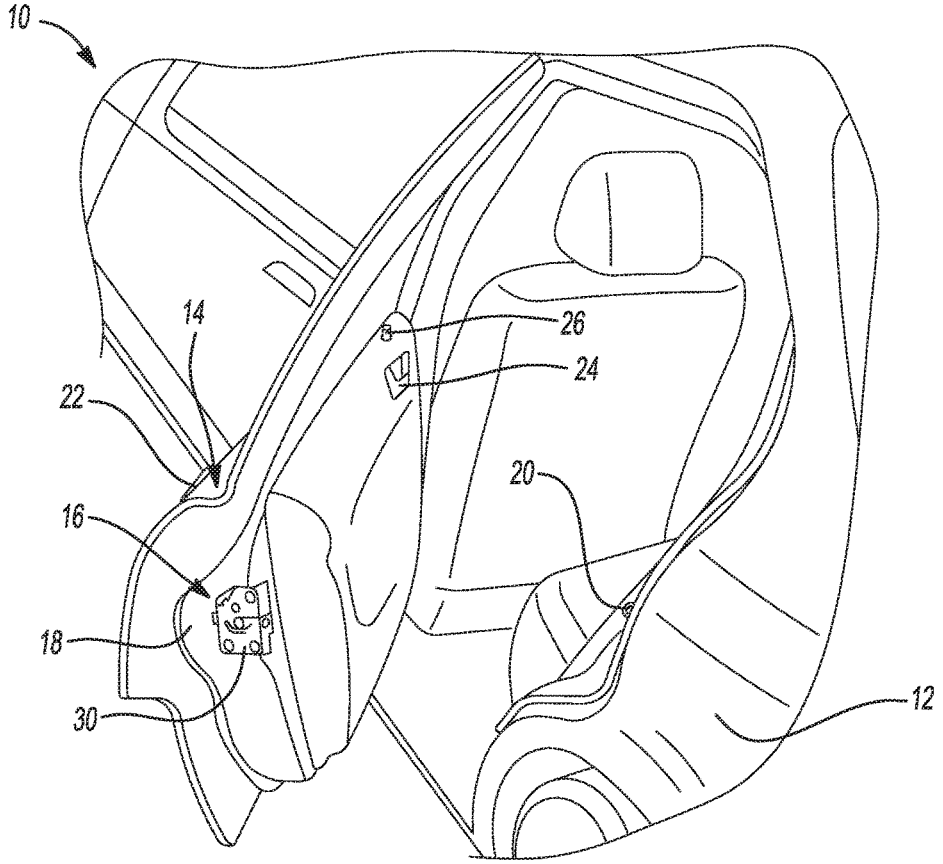
FIG. 1 is an isometric view of a motor vehicle having a passenger door equipped with a door latch assembly constructed in accordance with the teachings of the present disclosure.

FIGS. 12A through 12H are a series of sequential perspective views, which directly correspond to FIGS. 10A through 10H, during the latch closing operation of the single ratchet-double pawl latching mechanism associated with the door latch assembly of the present disclosure.

Corresponding reference numerals indicate corresponding parts throughout the several views of the drawings.

DETAILED DESCRIPTION

One or more example embodiments of a door latch assembly constructed in accordance with the present disclosure will now be more fully described. These example embodiments are generally directed to door latch assemblies having a single ratchet-double pawl type of latch mechanism. More specifically, the example embodiment shown in the drawings and described in the following detailed written description discloses a single ratchet-double pawl latch mechanism having a ratchet, a primary pawl and a secondary pawl configured such that the primary pawl includes a pair of distinct lugs operative in conjunction with a pair of closing notches formed on the ratchet to facilitate movement of the ratchet between the striker release position and the secondary and primary striker capture positions. However, the example embodiments are only provided so that this disclosure will be thorough, and will fully convey the scope to those who are skilled in the art. For example, the door latch assembly constructed in accordance with the present disclosure could be directed to door latch assemblies having a single ratchet-single pawl type of latch mechanism. More specifically, the door latch assembly could be directed to a single ratchet-single pawl latch mechanism having a ratchet and a single primary pawl configured such that the single primary pawl includes a pair of distinct lugs operative in conjunction with a pair of closing notches formed on the ratchet to facilitate movement of the ratchet between the striker release position and the secondary and primary striker capture positions. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

FIG. 1 is an isometric view of a portion of a motor vehicle 10 having a vehicle body 12 and at least one door 14 that is adapted to move pivotally between open and closed positions relative to vehicle body 12. Door 14 includes a latch assembly 16 that is positioned adjacent an edge surface 18 and which is configured to be releasably engageable with a striker 20 mounted to body 12 for releasably holding door 14 in its closed position. An outside door handle 22 and an inside door handle 24 are provided to permit release of latch assembly 16 from striker 20 so as to allow door 14 to be swung to its open position. A lock knob 26 is shown in association with door 14 to provide a visual indication of the lock state of latch assembly 16 and which may be operably configured to switch the lock state of latch assembly 16 between an unlocked mode and a locked mode.

Latch assembly 16 includes a latch housing 30 adapted to be rigidly secured to door 14 of vehicle 10. Latch housing 30 is configured to define a clam-shell type structural component defining an internal chamber within which components of a latch mechanism 28 associated with latch assembly 16 are located. In accordance with the present disclosure, latch mechanism 28 is a single ratchet-double pawl arrangement generally including a ratchet 32 (FIG. 2), a ratchet spring 34 (FIG. 3), a ratchet lever 36 (FIG. 3), a primary pawl 38 (FIG. 4), a primary pawl spring 40 (FIG. 4), a secondary pawl 42 (FIG. 5), a secondary pawl spring 44 (FIG. 5), a snow-load lever 46 (FIG. 6), and a snow-load lever spring 48 (FIG. 6). The interaction, interconnection and relative movement between three components of latch mechanism 28 will now be described in greater detail.

Figure 2A:
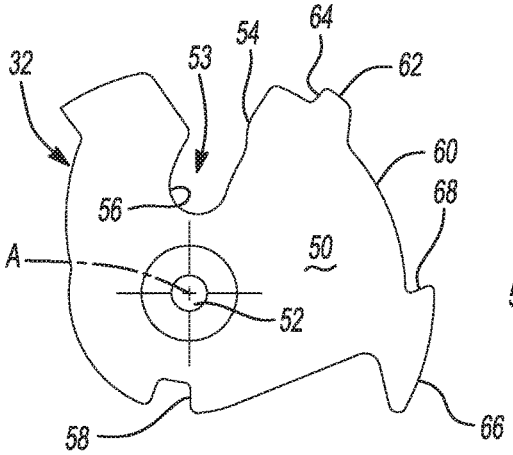
FIGS. 2A and 2B are top elevational and isometric views of a ratchet associated with a single ratchet-double pawl latch mechanism integrated into the door latch assembly of the present disclosure.
Figure 2B:
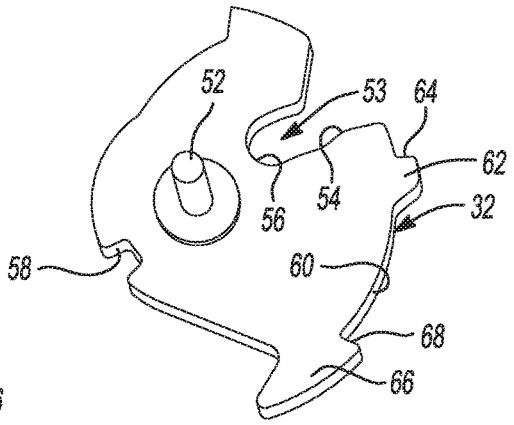

Referring initially to FIGS. 2A and 2B, ratchet 32 is shown configured to include a ratchet plate 50, a ratchet pivot post 52 extending from ratchet plate 50, a striker retaining area 53 having a guide channel 54 terminating in a striker capture slot 56, a retention notch 58, and a profiled edge 60 having a raised primary ratchet lug 62 defining a primary closing shoulder or notch 64 and a raised secondary ratchet lug 66 defining a secondary closing shoulder or notch 68. Pivot post 52 supports ratchet plate 50 within latch housing 30 for pivotable movement through a range of arcuate travel delineated between a striker release position and a primary striker capture position. As will be defined, a secondary striker capture position is provided between the striker release position and the primary striker capture position.

Figure 3A:
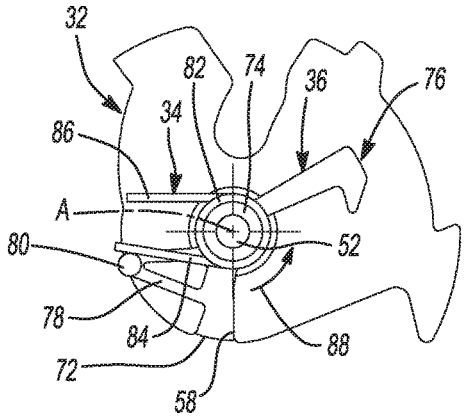
FIGS. 3A and 3B are top elevational and isometric views of a ratchet lever and ratchet spring shown operably mounted to the ratchet of FIGS. 2A and 2B and which are also associated with the single ratchet-double pawl latch mechanism of the present disclosure.
Figure 3B:
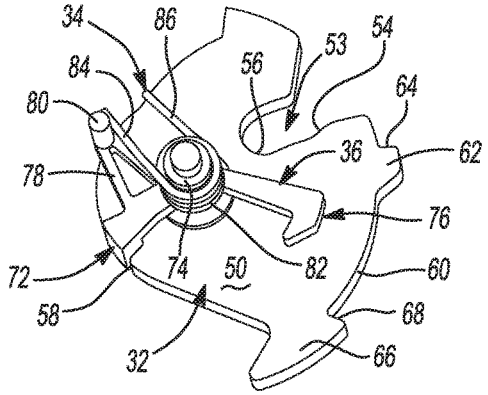

Referring now to FIGS. 3A and 3B, ratchet 32 is shown built-up with ratchet lever 36 which is configured to include a ratchet link segment 72 retained in retention notch 58, a tubular pivot segment 74 surrounding ratchet pivot post 52, a snow-load activation segment 76 overlying a portion of ratchet plate 50, and a spring retainer segment 78 having an upstanding lug 80. While indicated as separate components, it is possible for ratchet lever 36 to be integrated with ratchet 32. Ratchet spring 34 has a coiled segment 82 arranged to surround tubular pivot segment 74 of ratchet lever 36, a first end segment 84 engaging lug 80 on ratchet lever 36, and a second end segment 86 engaging a stationary portion of latch housing 30. Arrow 88 indicates the rotary direction that ratchet spring 34 normally biases ratchet 32 which, in this example, is the counterclockwise or "releasing" direction. Due to its direct connection, ratchet lever 36 rotates with ratchet 32 about a common ratchet pivot axis "A".

Figure 4A:
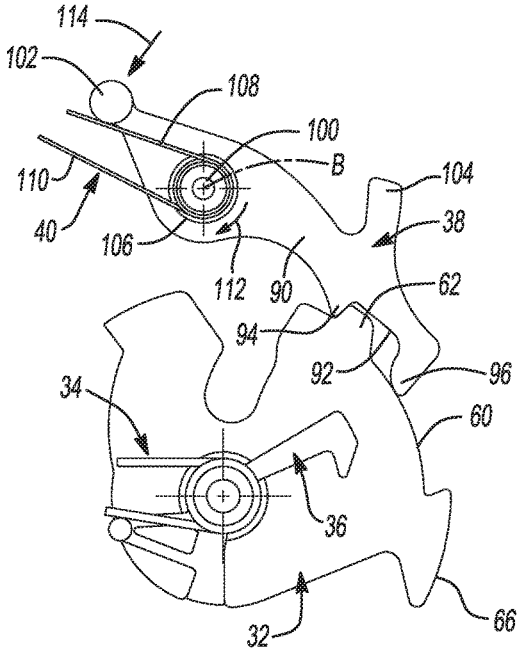
FIGS. 4A and 4B are generally similar to FIGS. 3A and 3B but further illustrate a primary pawl and a primary pawl spring operably associated with the single ratchet-double pawl latch mechanism of the present disclosure.
Figure 4B:
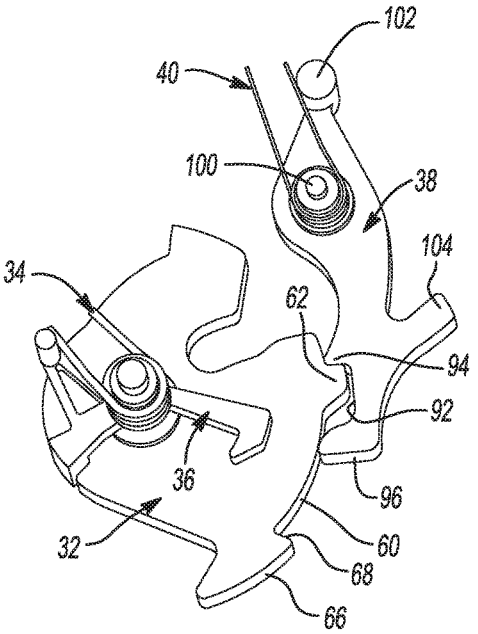

Referring now to FIGS. 4A and 4B, primary pawl 38 is shown configured to include a primary pawl plate 90 that is profiled along its edge to define a recess 92 delineated by a primary lug 94 and a secondary lug 96. As will be detailed, this profiled edge of primary pawl 38 is operatively associated with profiled edge 60 of ratchet 32 to establish various positions of the components. Primary pawl 38 also includes a primary pawl pivot post 100 extending from primary pawl plate 90 and which is mounted in latch housing 30 to facilitate pivotable movement of primary pawl 38 about a primary pawl axis "B". A primary pawl activation lug 102 extends from an opposite end of primary pawl plate 90. A primary pawl leg segment 104 extends outwardly from an edge of primary pawl plate 90.

Primary pawl spring 40 has a coil segment 106 surround primary pawl pivot post 100, a first end segment 108 engaging activation lug 102 on primary pawl 38, and a second end segment 110 engaging a stationary portion of latch housing 30. Arrow 112 indicates the rotary direction which primary pawl 38 is normally biased by primary pawl spring 40 which, in this example, is a clockwise or "engaging" direction. Similarly, arrow 114 indicates a "release" directional force that can be applied to activation lug 102 of primary pawl 38 via a latch release mechanism to forcibly pivot primary pawl 38 in a counterclockwise or "disengaging" direction, in opposition to the biasing normally applied thereto via primary pawl spring 40. As will also be detailed, primary lug 94 on primary pawl 38 defines an "eccentric" profile while secondary lug 96 defines a "concentric" profile. The eccentric profile of primary lug 94 cooperates with primary closing notch 64 of ratchet 32 when ratchet 32 is located in its primary striker capture position to establish an eccentric directional force vector. In contrast, the concentric profile of secondary lug 96 on primary pawl 38 cooperates with secondary closing notch 68 of ratchet 32 when ratchet 32 is located in its secondary striker capture position to establish a concentric directional force vector.

Figure 5A:
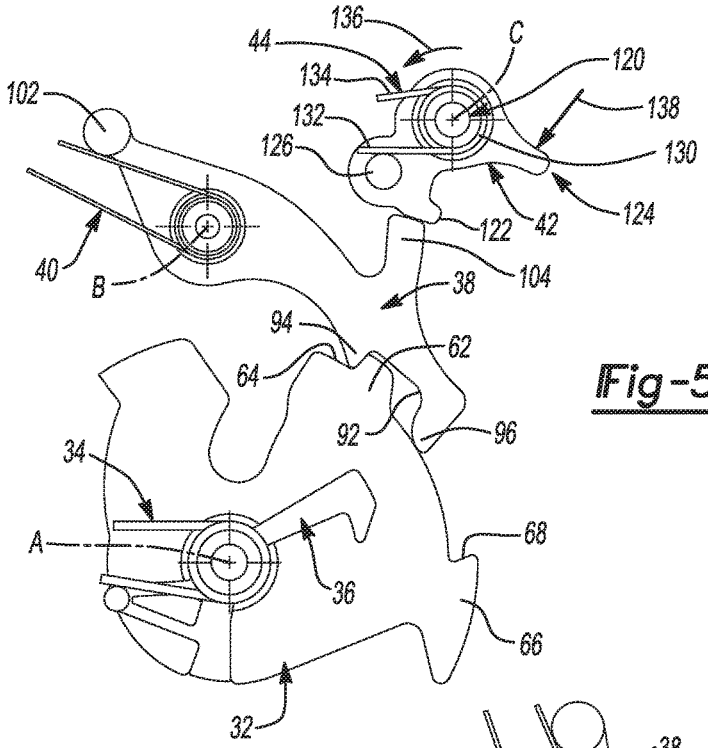
FIGS. 5A and 5B are generally similar to FIGS. 4A and 4B but further illustrate a secondary pawl and a secondary pawl spring operably associated with the single ratchet-double pawl latch mechanism of the present disclosure.
Figure 5B:
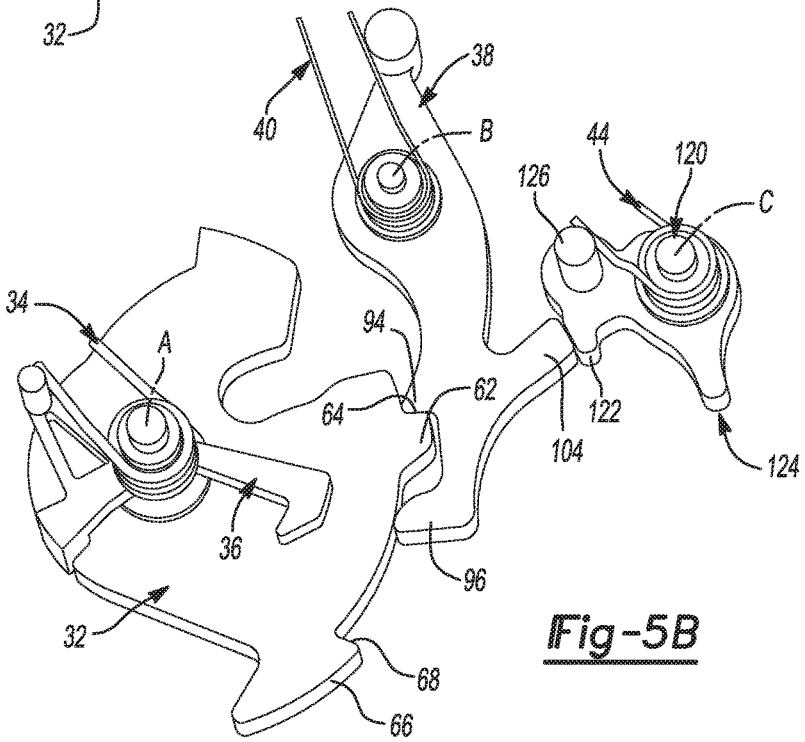

With attention directed now to FIGS. 5A and 5B, secondary pawl 42 is shown configured to include a secondary pawl pivot post 120, a secondary pawl leg segment 122, a secondary pawl activation lug 124, and a spring retainer lug 126. Pawl pivot post 120 is mounted within latch housing 30 to permit pivotable movement of secondary pawl 42 about a secondary pawl axis "C". As seen, secondary pawl leg segment 122 is configured to selectively engage primary pawl leg segment 104 of primary pawl 38. Secondary pawl spring 44 includes a coil segment 130 surrounding secondary pawl pivot post 120, a first end segment 132 engaging spring retainer lug 126, and a second end segment 134 engaging a stationary portion of latch housing 30. Arrow 136 indicates the rotary direction which secondary pawl spring 44 biases secondary pawl 44 which, in this example is in a counterclockwise or "engaging" direction. Arrow 138 indicates a "release" directional force that can be selectively applied to secondary pawl activation lug 124 via the latch release mechanism in a clockwise or "disengaging" direction, in opposition to the biasing normally applied to secondary pawl 42 via secondary pawl spring 44.

Figure 6A:
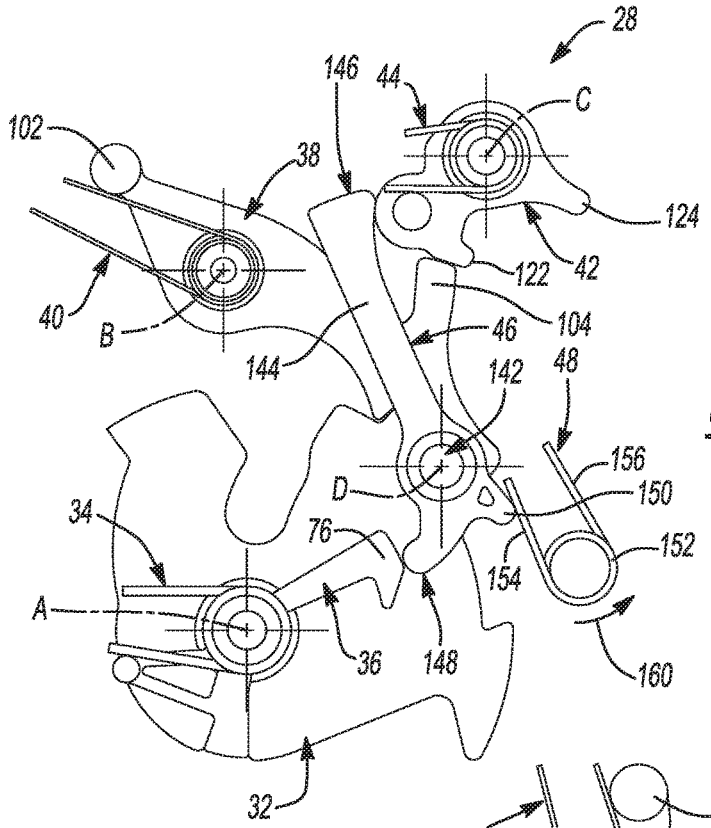
FIGS. 6A and 6B are generally similar to FIGS. 5A and 5B but further illustrate a snow-load lever and a snow-load lever spring operably associated with the single ratchet-double pawl latch mechanism of the present disclosure.
Figure 6B:
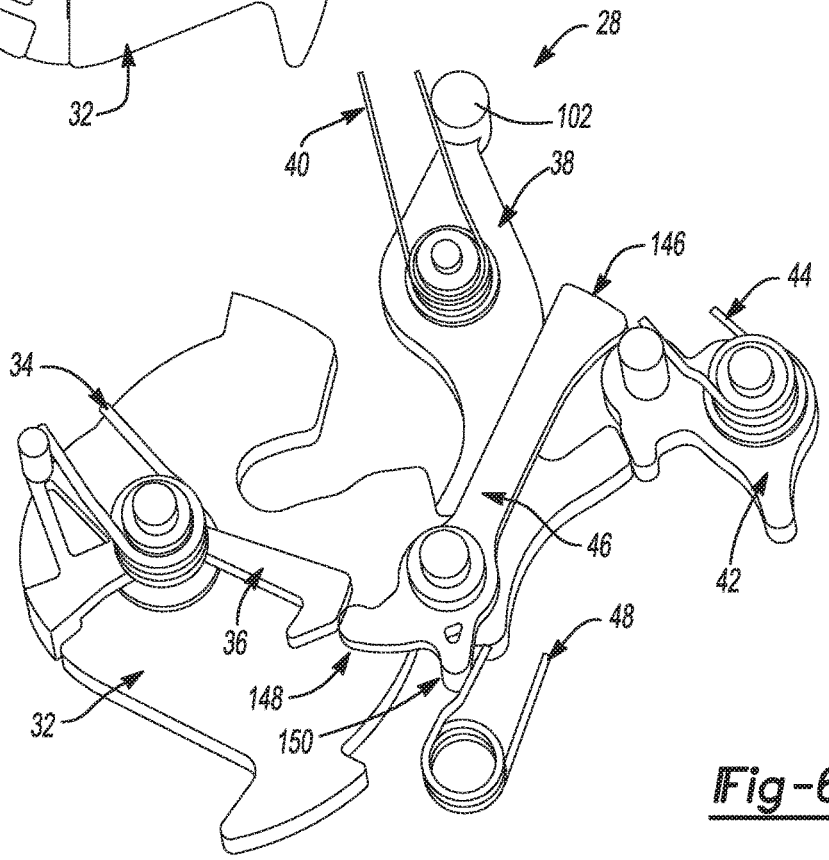

FIGS. 6A and 6B illustrate the addition of snow-load lever 46 and snow-load lever spring 48 to the latch components shown in FIGS. 5A and 5B, respectively. In particular, snow-load lever 46 includes a snow-load lever pivot post 142, an elongated blocking leg segment 144 having a blocking edge profile surface 146, an activation leg segment 148 configured to selectively interact with snow-load activation segment 76 of ratchet lever 36, and a spring retainer segment 150. Snow-load lever pivot post 142 is mounted to a stationary portion of latch housing 30 to permit pivotable movement of snow-load lever 46 about a snow-load lever axis "D". Snow-load lever spring 48 has a coiled segment 152, a first end segment 154 engaging spring retainer segment 150 of snow-load lever 46, and a second end segment 156 abutting a stationary portion of latch housing 30. Arrow 160 indicates the biasing force normally applied by snow-load lever spring 48 on snow-load lever 46 which, in this example, is in a counterclockwise or "engaging" direction.

With the general arrangement of the components associated with single ratchet-double pawl latch mechanism 28 of door latch assembly 16 having been shown and described in relation to FIGS. 2 through 6, the various operative interconnections, positions and modes/states will now be the primary focus of the remaining disclosure. Specifically, FIGS. 7A through 7F illustrate a sequential series of top elevational views of the components of latch mechanism 28 during a "latch release" operation which functions to permit ratchet 32 to rotate about axis "A" from its primary striker capture position (FIG. 7A) to its striker release position (FIG. 7F) so as to permit striker 20 to move out of striker retainer area 53 and allow door 14 to swing from its closed position toward its open position. To provide additional clarity of the interaction between the various components of single ratchet-double pawl latch mechanism 28 during this latch release operation, FIGS. 8A through 8F provide a sequential series of bottom elevational views and which directly correspond to FIGS. 7A through 7F. Additionally, FIGS. 9A through 9F provide a series of sequential isometric views which also correspond directly to FIGS. 7A through 7F.

Figure 9A:
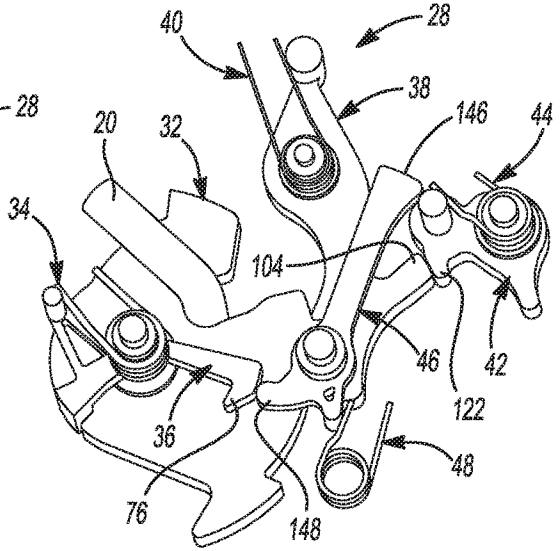
FIGS. 9A through 9F are a sequential series of isometric views, which directly correspond to FIGS. 7A through 7F, during the latch release operation for permitting the ratchet to move from its primary striker capture position (FIG. 9A) to its striker release position (FIG. 9F)
Figure 8A:
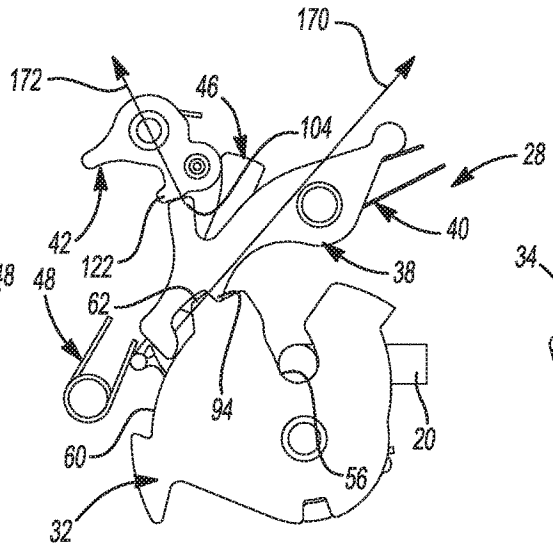
FIGS. 8A through 8F are a sequential series of bottom elevational views of the single ratchet-double pawl latch mechanism, which directly correspond to FIGS. 7A through 7F, during the latch release operation for permitting the ratchet to move from its primary striker capture position (FIG. 8A) to its striker release position (FIG. 8F)
Figure 7A:
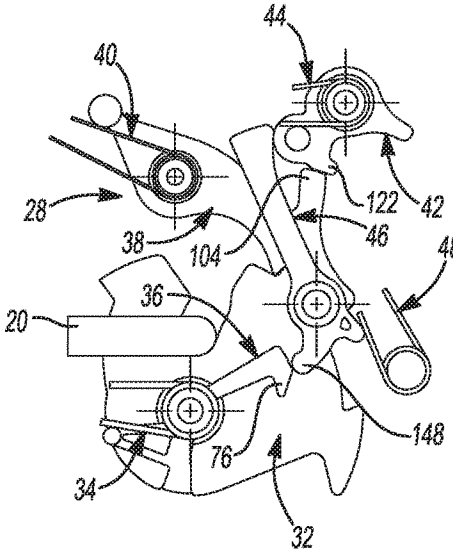
FIGS. 7A through 7F are a sequential series of top elevational views of the single ratchet-double pawl latch mechanism illustrating relative movement of the components during a latch release operation for permitting the ratchet to move from a primary striker capture position (FIG. 7A) to a striker release position (FIG. 7F)

Referring initially to FIGS. 7A, 8A and 9A, single ratchet-double pawl latch mechanism 28 is shown in a first or "Latched" operating mode with striker 20 retained in slot portion 56 of guide channel 54 when ratchet 32 is held in its primary striker capture position. Primary pawl 38 is shown biased by primary pawl spring 40 into an engaged position with respect to ratchet 38 while secondary pawl 42 is shown biased by secondary pawl spring 44 into an engaged position with respect to primary pawl 38. Snow-load lever 46 is shown held in a disengaged position with respect to secondary pawl 42 via engagement of activation segment 76 on ratchet lever 36 with activation leg segment 148 on snow-load lever 46. In particular, primary pawl 38 functions to hold ratchet 32 in its primary striker capture position when primary pawl 38 is located in its engaged position, as is best seen from FIG. 8A, by engagement of primary lug 94 on primary pawl 38 with primary closing notch 64 on ratchet 32. In view of the eccentric profile of primary lug 94, this engagement establishes an over-center latching arrangement resulting in an eccentric directional force vector, as indicated by arrow 170. In addition, secondary pawl 42 is operable in its engaged position to hold primary pawl 38 in its engaged position via engagement of secondary pawl leg segment 122 with primary pawl leg segment 104. The concentric directional force vector generated via this engagement between secondary pawl 42 and primary pawl 38 is indicated by arrow 172.

Figure 9B:
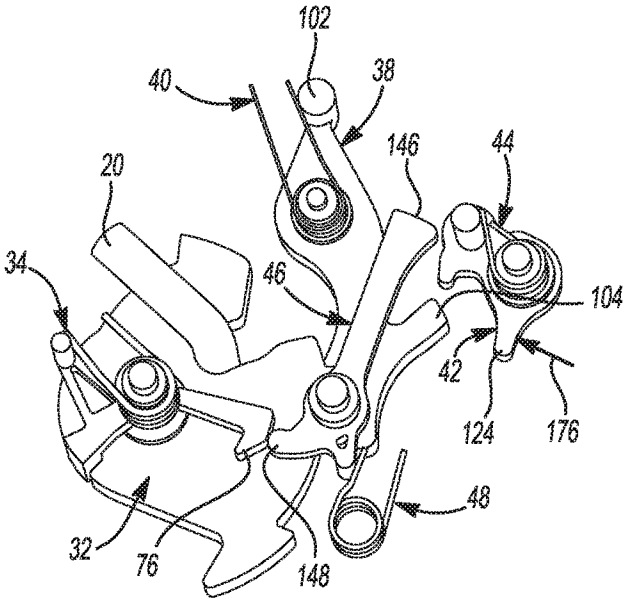
Figure 8B:
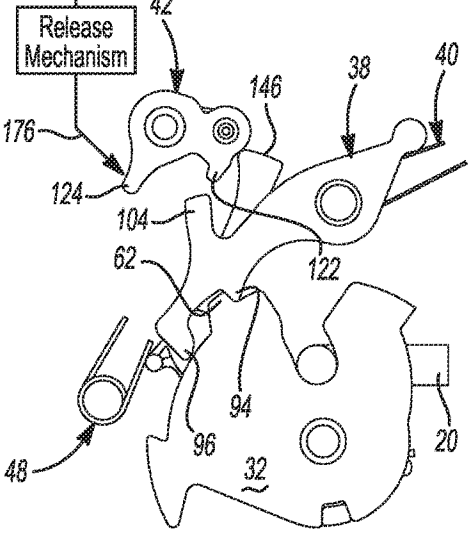
Figure 7B:
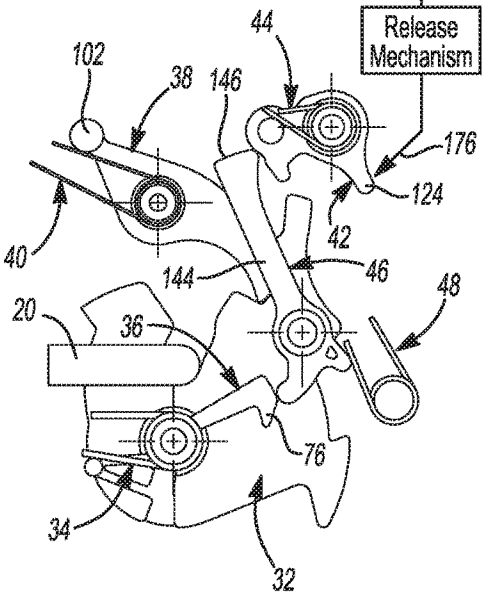
Figure 9C:
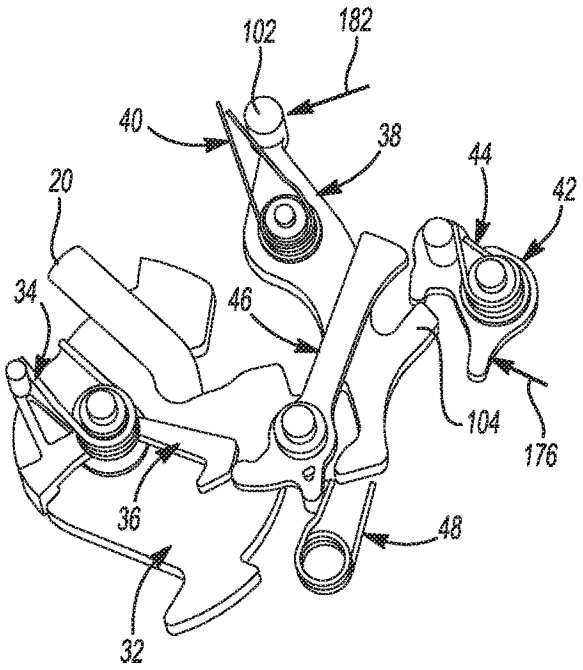
Figure 8C:
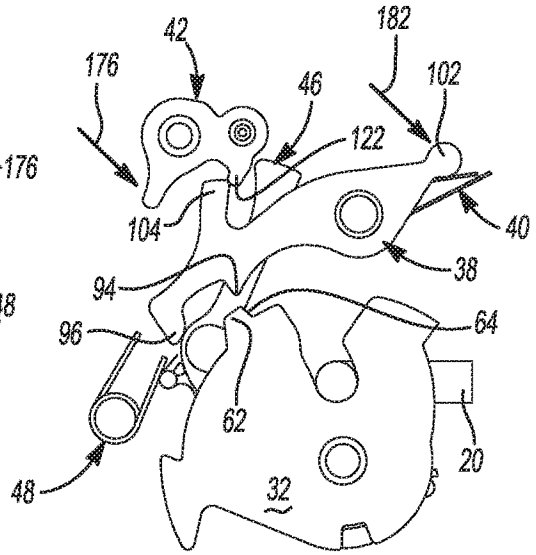
Figure 7C:
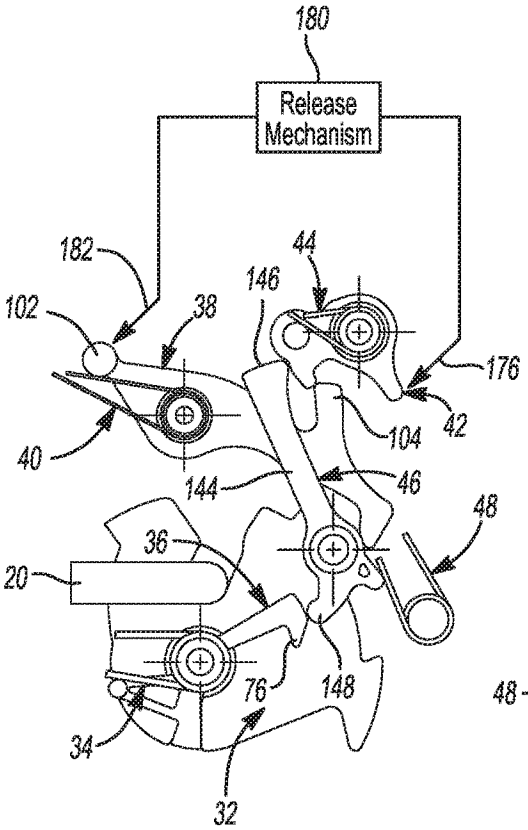

FIGS. 7B, 8B and 9B show initial rotation of secondary pawl 42 in its releasing direction by a latch release force (arrow 176) being applied to secondary pawl activation lug 124 via the latch release mechanism, identified schematically by block 180. This initial rotation of secondary pawl 42 in the releasing direction, in opposition to the biasing of secondary pawl spring 44, results in movement of secondary pawl 38 from its engaged position into a disengaged position. Subsequently, FIGS. 7C, 8C and 9C show release mechanism 180 also initiating forced rotation of primary pawl 38, in opposition to the biasing of primary pawl spring 40, in its releasing direction by the application of a latch release force (arrow 182) on activation lug 102. This rotation results in primary pawl 38 moving from its engaged position into a disengaged position. This movement of primary pawl 38 into its disengaged position (see FIG. 8C) results in the release of primary lug 94 on primary pawl 38 from primary closing notch 64 on ratchet 32. As such, ratchet spring 34 is permitted to forcibly pivot ratchet 32 from its primary striker capture position in the releasing direction toward its striker release position.

Figure 9D:
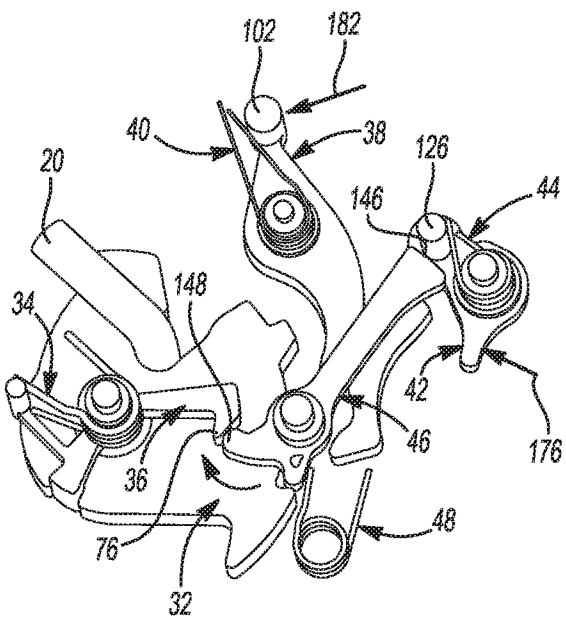
Figure 8D:
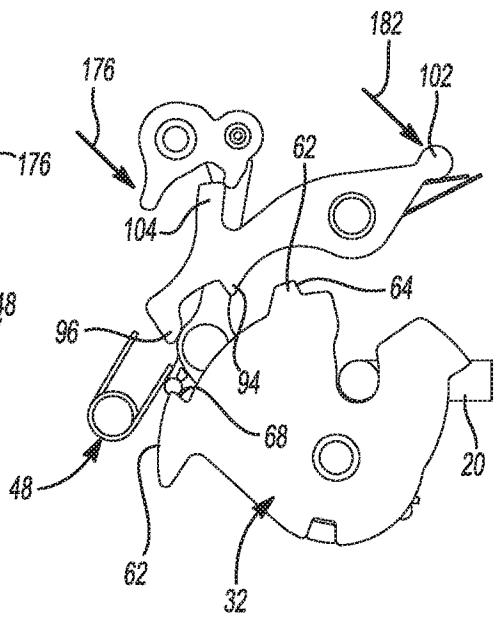
Figure 7D:
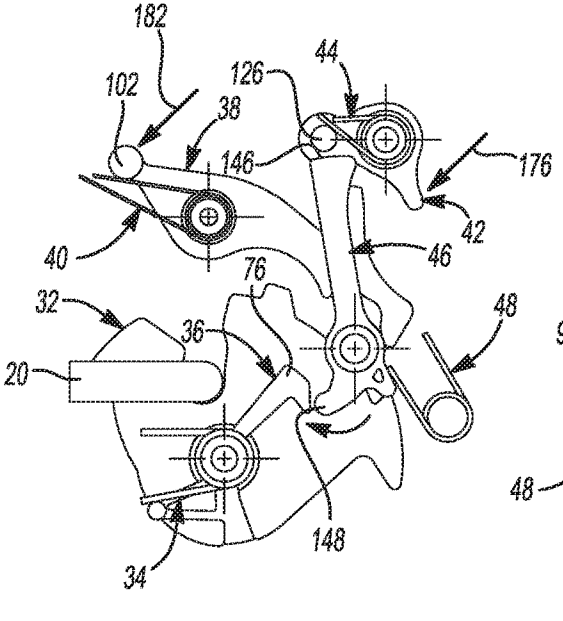
Figure 9E:
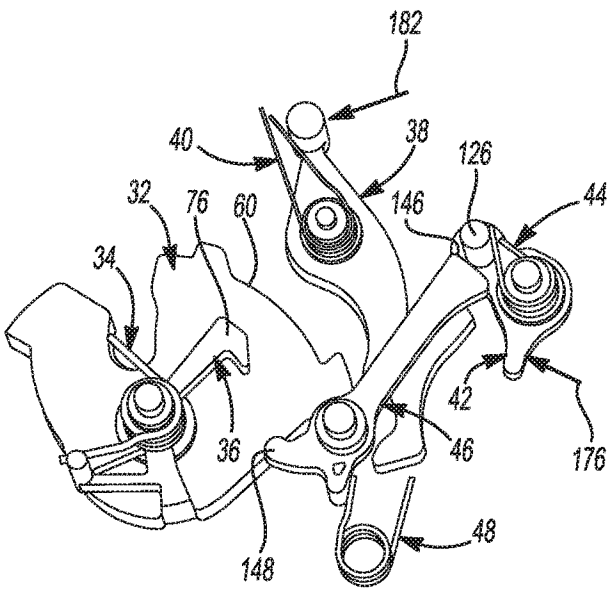
Figure 8E:
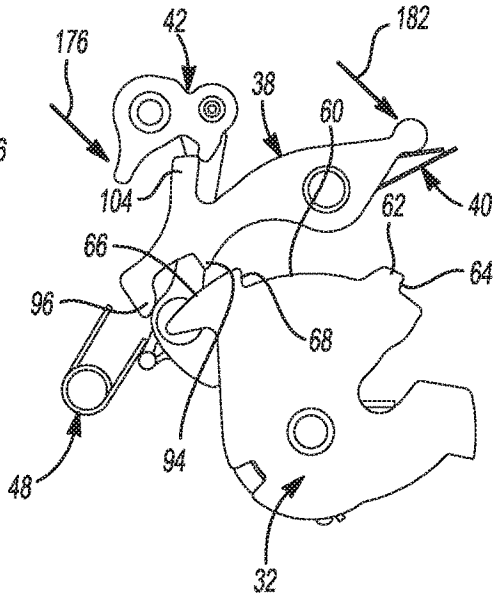
Figure 7E:
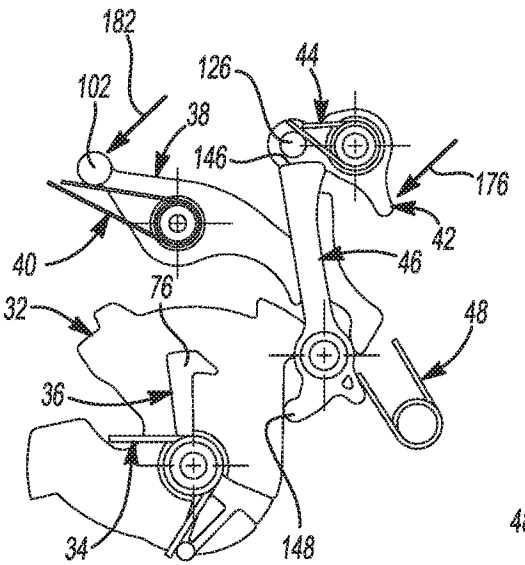
Figure 9F:
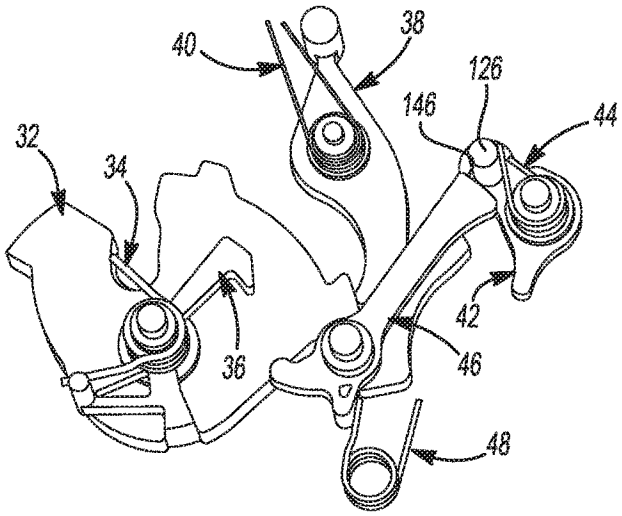
Figure 8F:
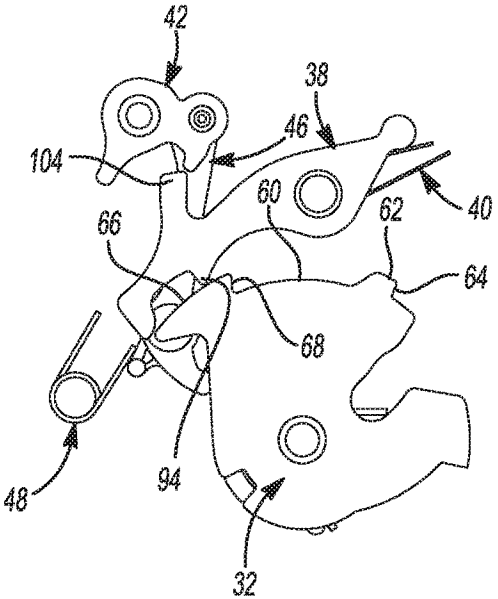
Figure 7F:
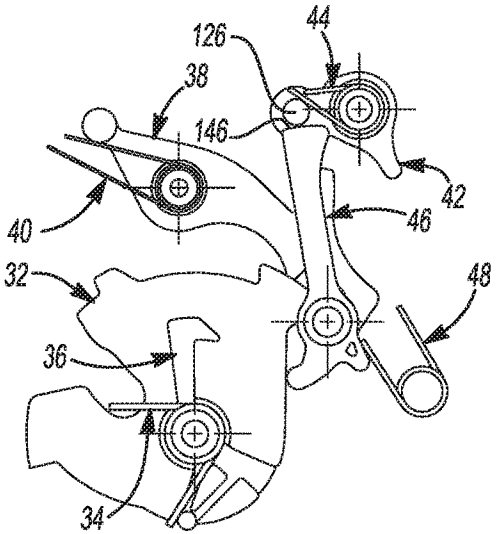

FIGS. 7D, 8D and 9D illustrate that continued rotation of ratchet 32 it is releasing direction causes the edge profile on snow-load activation segment 76 on ratchet lever 36 to disengage activation leg segment 148 on snow-load lever 46, thereby permitting snow-load lever spring 48 to forcibly rotate snow-load lever 46 from its disengaged position into an engaged position. With snow-load lever 46 located in its engaged position, its blocking edge profile 146 is aligned with and may engage blocking lug 126 on secondary pawl 42 so as to hold secondary pawl 42 in its disengaged position, in opposition to the biasing of secondary pawl spring 44. FIGS. 7E, 8E and 9E illustrate the subsequent continued rotation of ratchet 32 to its striker release position. Thereafter, the release forces 176, 182 exerted by latch release mechanism 180 are removed. In the arrangement shown in FIGS. 7F, 8F and 9F, secondary pawl 42 is held in its disengaged position by snow-load lever 46 while primary pawl 38 is held in its disengaged position via engagement of primary lug 94 with raised secondary ratchet lug 66 on ratchet 32. This arrangement illustrates latch mechanism 28 in a second or "Unlatched" operating mode.

Figure 10A:
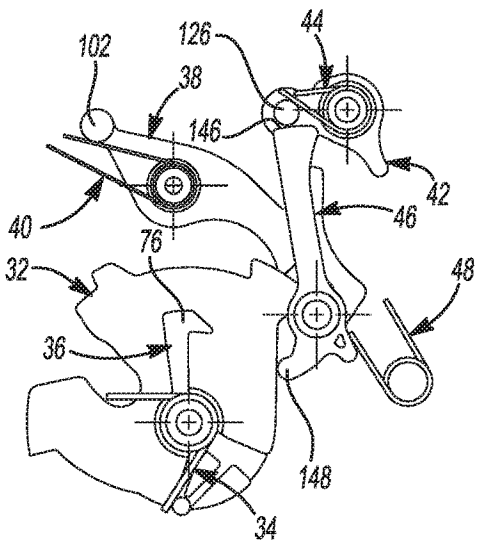
FIGS. 10A through 10H are a sequential series of top elevational views of the single ratchet-double pawl latch mechanism illustrating relative movement of the components during a latch close operation which results in movement of the ratchet from its striker release position (FIG. 10A) through a secondary striker capture position (FIG. 10C) and into its primary striker capture position (FIG. 10H)
Figure 10B:
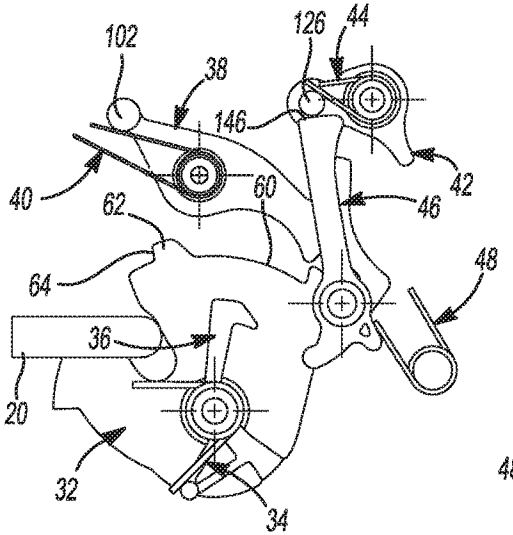
Figure 10C:
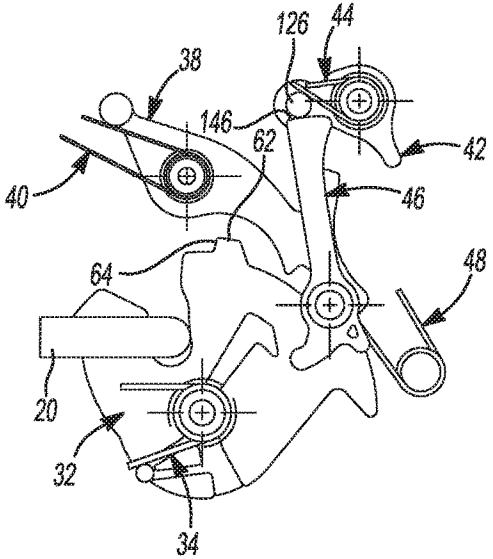
Figure 10D:
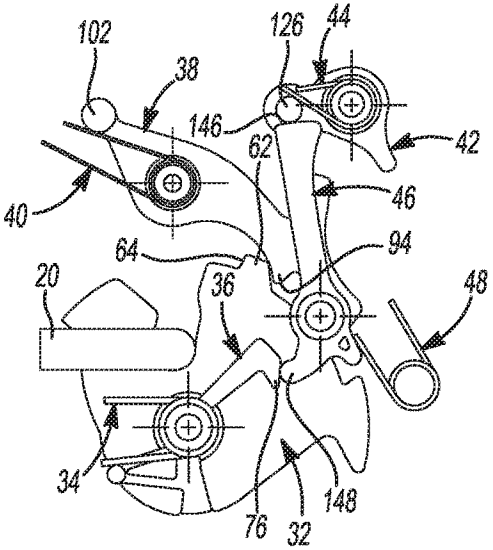
Figure 10E:
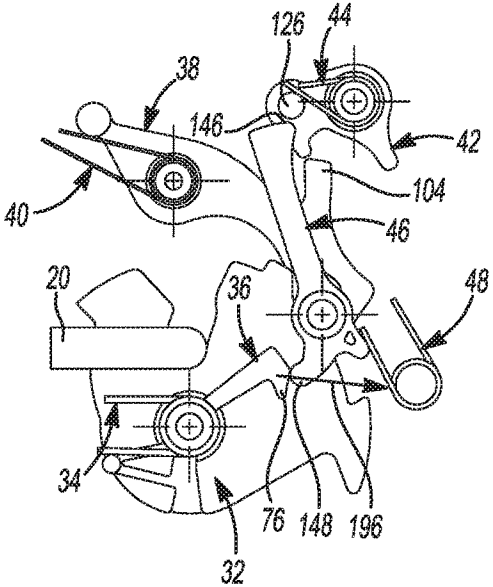
Figure 10F:
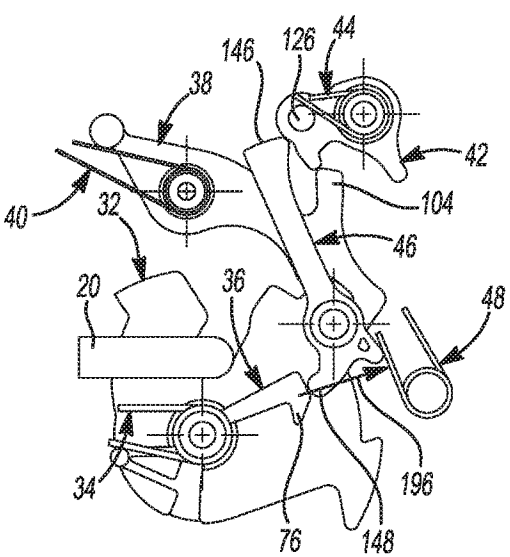
Figure 10G:
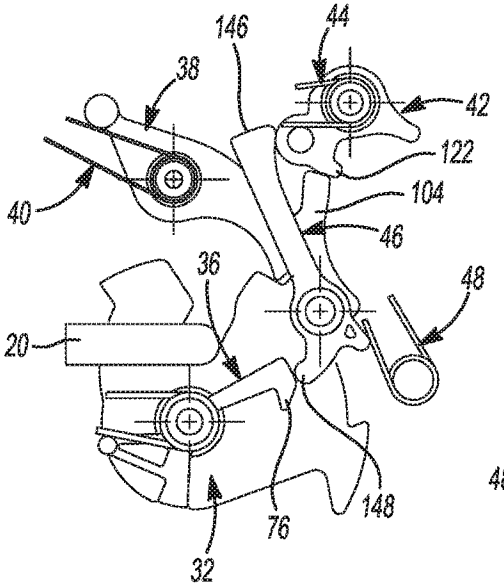
Figure 10H:
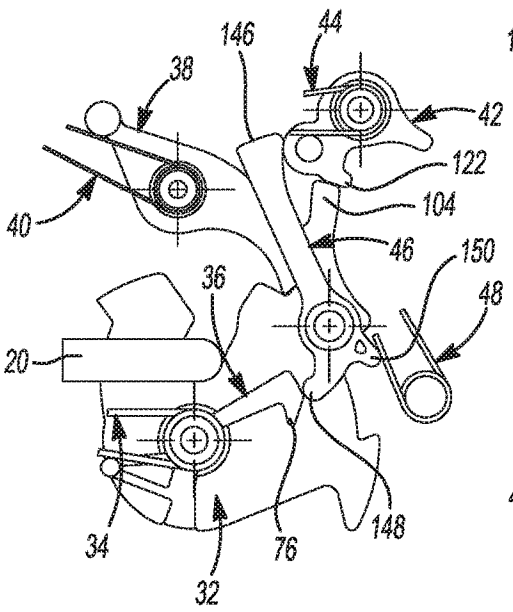

In a similar fashion to the above description of the latch release function, FIGS. 10A through 10H are a sequential series of top elevational views of the components of single ratchet-double pawl latch mechanism 28 during a "latch close" operation which functions to rotate ratchet 32 from its striker release position (FIG. 10A) initially through a secondary striker capture position (FIG. 10C) and into its primary striker capture position (FIG. 10H). To provide additional clarity of the interaction between the components during this closing operation, FIGS. 11A-11H provide a series of sequential bottom elevational views which correspond directly to FIGS. 10A-10H. Additionally, FIGS. 12A-

12H provide a series of sequential isometric views also directly corresponding to FIGS. 10A-10H.

Figure 12A:
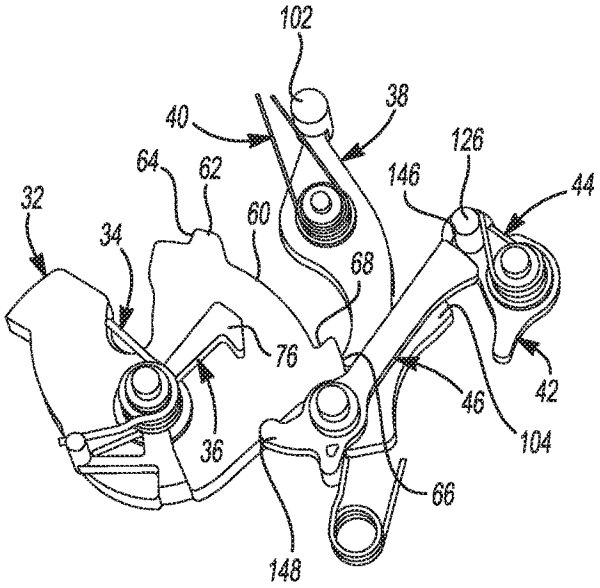
Figure 11A:
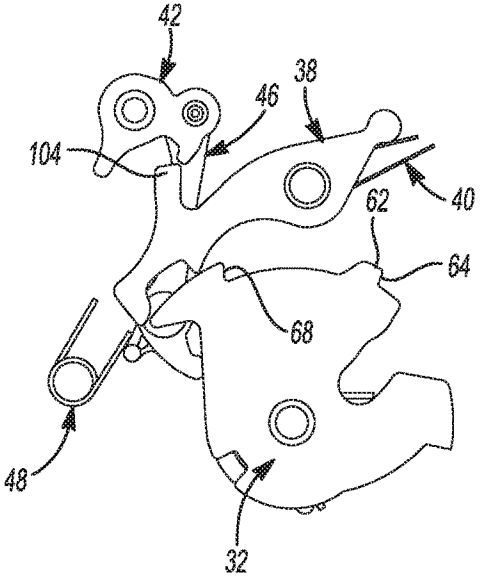
FIGS. 11A through 11H are a sequential series of bottom elevational views, which directly correspond to FIGS. 10A through 10H, during the latch closing operation of the single ratchet-double pawl latching mechanism.
Figure 12B:
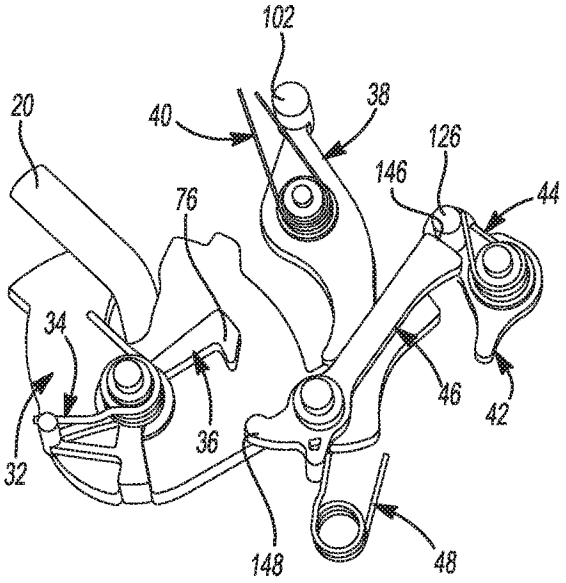
Figure 11B:
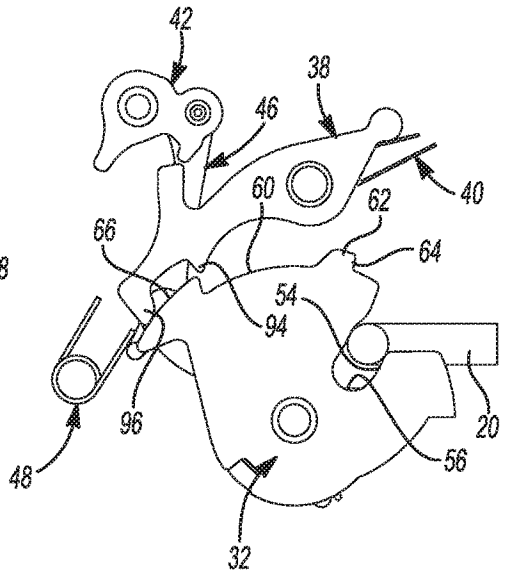
Figure 12C:
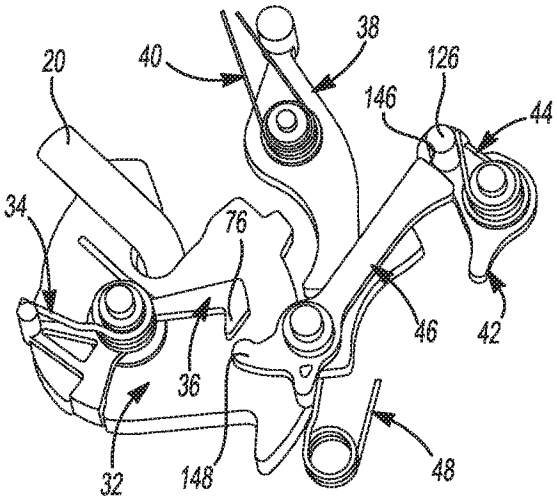
Figure 11C:
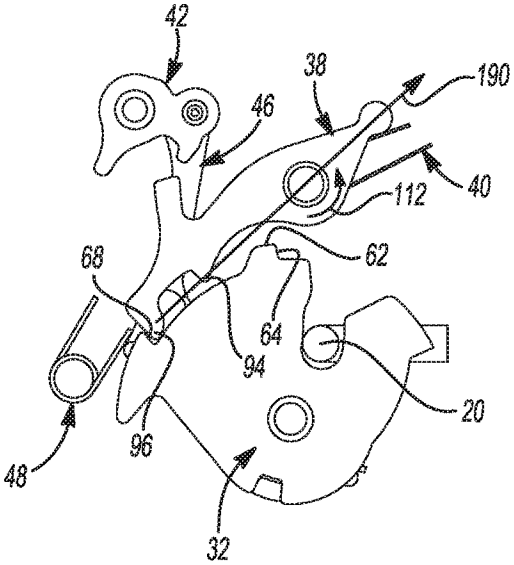

Referring initially to FIGS. 10A, 11A and 12A, single ratchet-double pawl latch mechanism 28 is shown in its Unlatched operating mode with ratchet 32 located in its striker release position, primary pawl 38 held by ratchet 32 in its disengaged position, and secondary pawl 42 held in its disengaged position by snow-load lever 46 being located in its engaged position. FIGS. 10B, 11B and 12B illustrate initial entry of striker 20 into guide channel 54 of ratchet 32 which causes initial rotation of ratchet 32 about axis "A" in a closing direction from its striker release position toward its secondary striker capture position. This initial rotation causes secondary lug 96 on primary pawl 38 to ride along the outer surface of raised secondary ratchet lug 66 on ratchet 32 so as to maintain primary pawl 38 in its disengaged position. FIGS. 10C, 11C and 12C illustrate rotation of ratchet 32 into its secondary striker capture position such that secondary lug 96 on primary pawl 38 drops off of the outer surface of raised secondary ratchet lug 66 and into sliding engagement with a recessed surface formed on profiled edge 60 on ratchet 32, whereby primary pawl 38 pivots back into its engaged position due to the spring force exerted thereon by primary pawl spring 40. This arrangement results in a concentric directional force, as indicated by arrow 190. It will be noted that secondary pawl 42 is maintained in its disengaged position via engagement with snow-load lever 46.

Figure 12D:
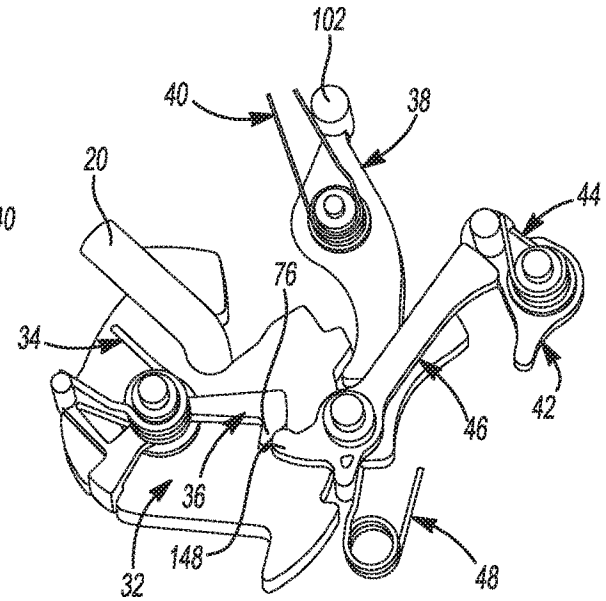
Figure 11D:
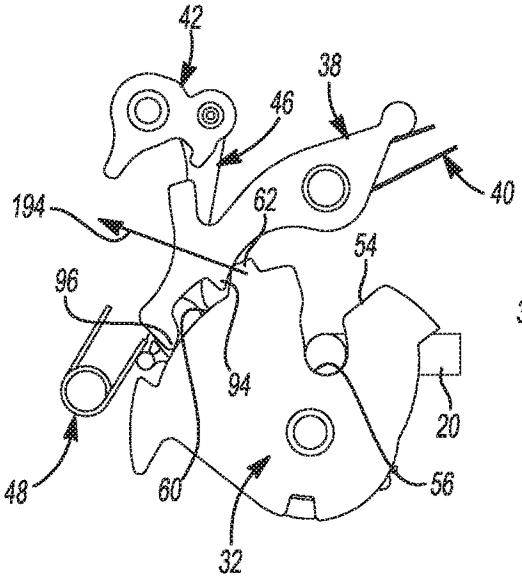
Figure 12E:
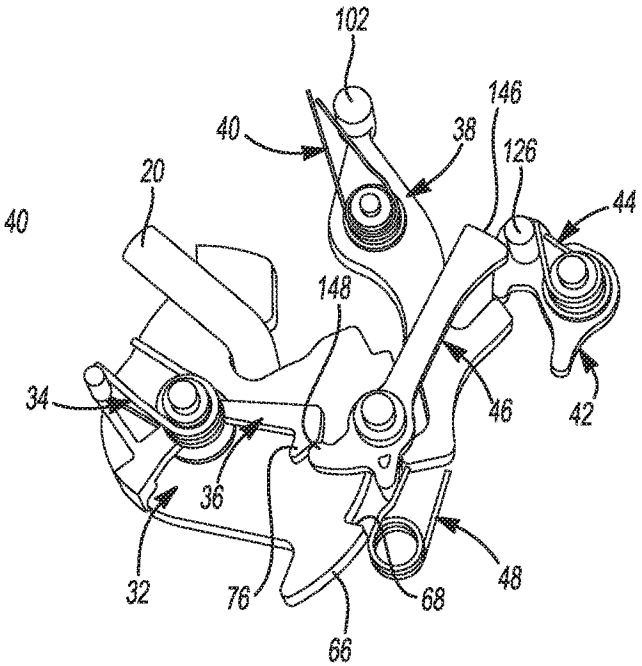
Figure 11E:
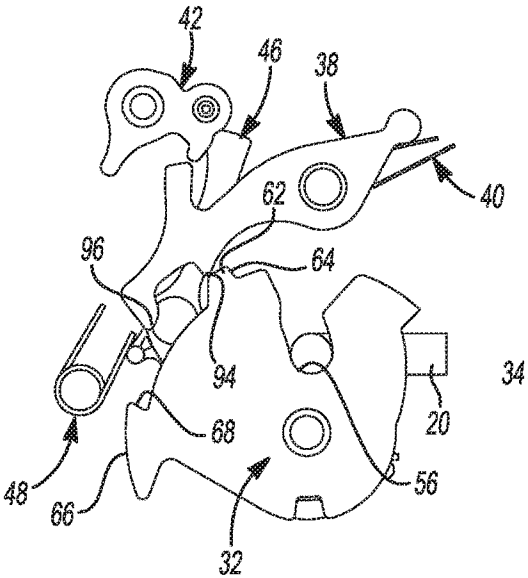

FIGS. 10D, 11D and 12D illustrate continued rotation of ratchet 32 in its closing direction resulting in engagement of primary lug 94 on primary pawl 38 with raised primary ratchet lug 62 on ratchet 32. This engagement results in a "camming" action as indicated by arrow 194. FIGS. 10E, 11E and 12E illustrate ratchet 32 forcibly pivoting primary pawl 38 in its releasing direction due to this camming action. Additionally, while secondary pawl 42 is maintained in its disengaged position by snow-load lever 46, continued rotation of ratchet 32 in its closing direction causes snow-load activation segment 76 on ratchet lever 36 to engage activation leg segment 148 on snow-load lever 46, thereby pivoting snow-load lever 46 about its axis "D" and against the biasing of snow-load lever spring 48, as indicated by arrow 196.

Figure 12F:
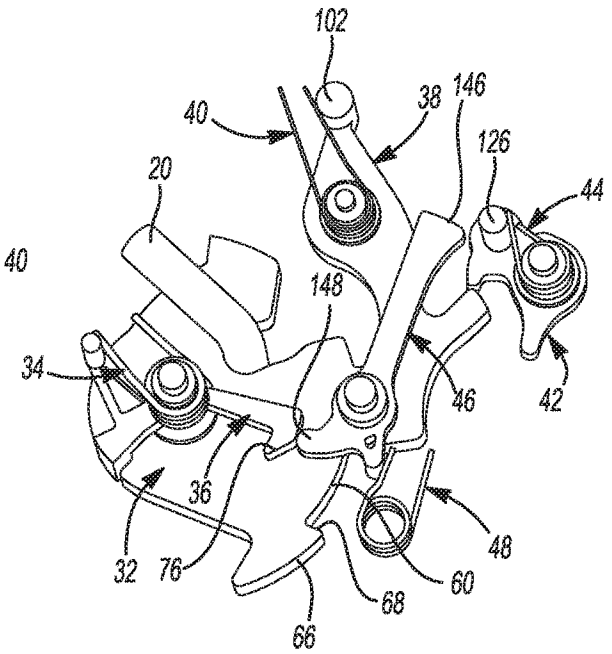
Figure 11F:
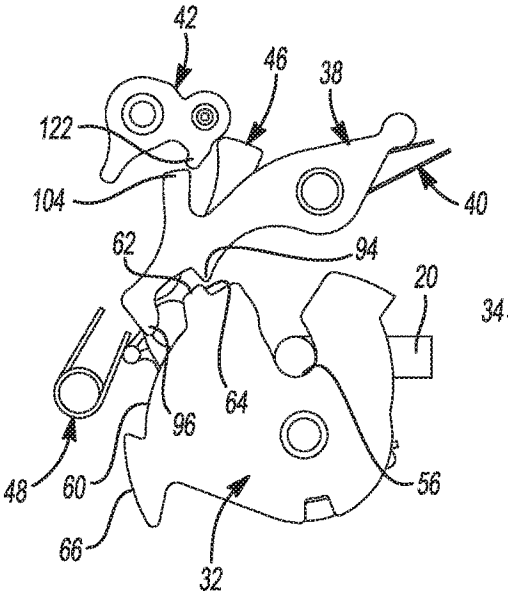
Figure 12G:
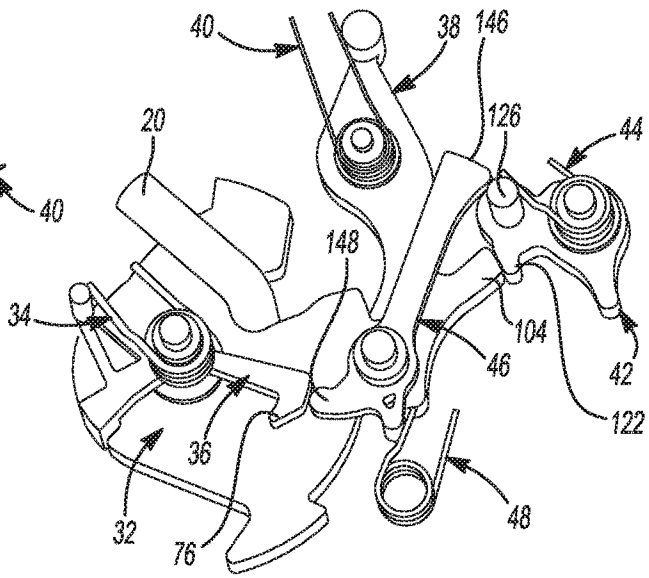
Figure 11G:
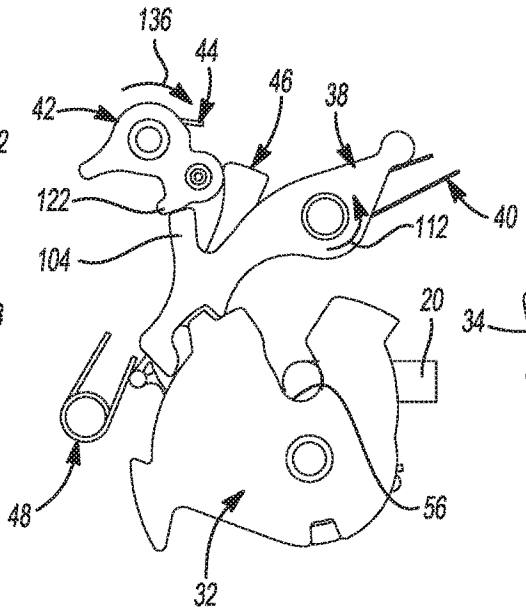
Figure 12H:
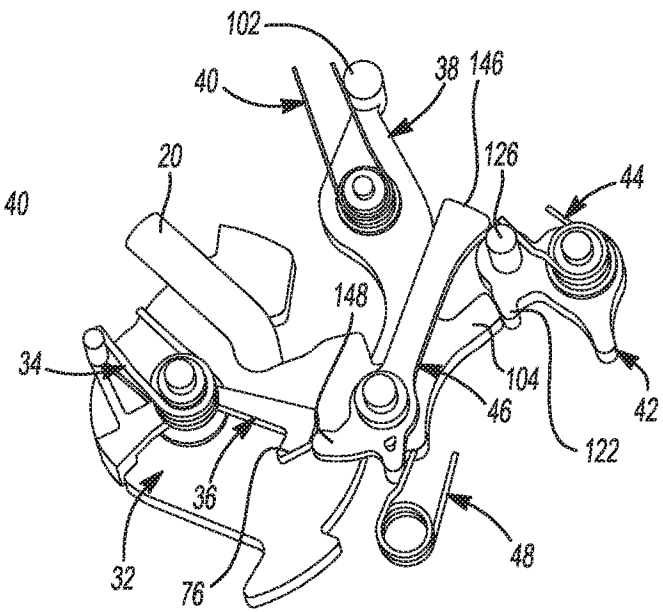
Figure 11H:
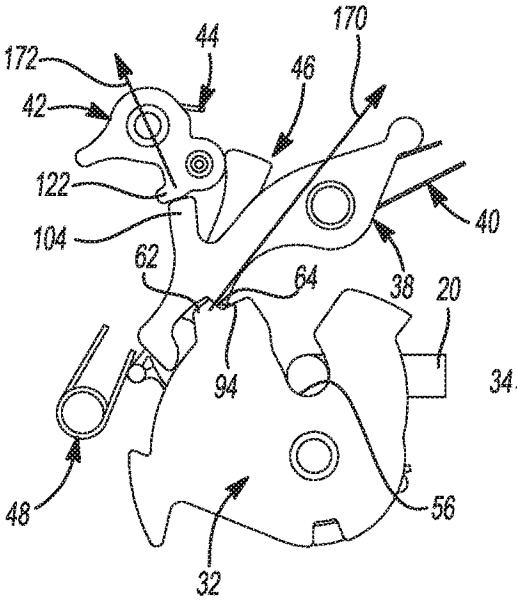

FIGS. 10F, 11F and 12F show ratchet 32 rotated by striker 20 into its primary striker capture position. Additionally, primary pawl 38 is now free to rotate toward its engaged position via primary pawl spring 40 since primary lug 94 has cammed over primary ratchet lug 62 and is aligned with primary closing notch 64. Likewise, ratchet lever 36 has rotated snow-load lever 46 sufficiently to release secondary pawl 38, thereby permitting secondary pawl spring 44 to forcibly rotate secondary pawl 42 toward its engaged position which, in turn, causes secondary pawl leg segment 122 to engage primary pawl leg segment 104 on primary pawl 38. FIGS. 10G, 11G and 12G show this biasing activity while FIGS. 10H, 11H and 12H illustrate latch mechanism 28 returned to its Latched operating state.

In the non-limiting single ratchet-double pawl arrangement disclosed above, primary pawl 38 has two distinct profiles, one with a "neutral" backout characteristic and the other with a "negative" backout characteristic, both established by working in conjunction with ratchet 32. Specifically, the neutral backout characteristic is established when ratchet 32 is located in its secondary striker capture position while the negative backout characteristic is established when ratchet 32 is located in its primary striker capture position. This profile in the secondary striker capture position is eccentric in order that the sealing loads cannot push primary pawl 38 out of its travel trajectory. Specifically, further movement is inhibited by secondary pawl 42. As noted, a first release force is initially exerted on secondary pawl 42 via a release lever associated with latch release mechanism 180 which is subsequently assisted by a second release force being exerted on primary pawl 38. The release force required by the release lever is relatively small and the seal pressure assists in releasing primary pawl 38. Release mechanism 180 can be operated manually via mechanical release systems or, in the alternative, it can be operated using power-operated actuators to provide a power release function.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A vehicle door latch assembly, comprising:

a ratchet moveable between a striker release position whereat the ratchet is positioned to receive a striker and primary and secondary striker capture positions whereat the ratchet is positioned to retain the striker, the ratchet being biased toward the striker release position;

a ratchet lever coupled for movement with the ratchet and having a ratchet lever activation segment;

a primary pawl moveable between an engaged position whereat the primary pawl is positioned to hold the ratchet in one of its primary and secondary striker capture positions and a disengaged position whereat the primary pawl permits movement of the ratchet to its striker release position, the primary pawl being biased toward the engaged position;

a secondary pawl moveable between an engaged position whereat the secondary pawl is positioned to hold the primary pawl in the engaged position and a disengaged position whereat the secondary pawl permits movement of the primary pawl to the disengaged position, the secondary pawl being biased toward the engaged position; and a snow-load lever moveable between a disengaged position whereat the snow-load lever permits movement of the secondary pawl between the engaged and disengaged positions and an engaged position whereat the snow-load lever is positioned to hold the secondary pawl in the disengaged position, the snow-load lever being biased toward the engaged position, wherein the ratchet lever activation segment of the ratchet lever engages and holds the snow-load lever in the disengaged position when the ratchet is located in the primary striker capture position, wherein movement of the ratchet in a releasing direction from the primary striker capture position causes the ratchet lever activation segment to disengage the snow-load lever and permit the snow-load lever to move from the disengaged position into the engaged position, wherein movement of the ratchet in a closing direction from the secondary strike capture position into the primary striker capture position causes the ratchet lever activation segment to engage the snow-load lever and cause the snow-load lever to move from the engaged position into the disengaged position, wherein an eccentric directional force vector is established between the ratchet and the primary pawl when the primary pawl is located in the engaged position and the ratchet is located in its primary striker capture position and wherein a concentric directional force vector is established between the ratchet and the primary pawl when the primary pawl is located in the engaged position and the secondary pawl is in the disengaged position and the ratchet is located in the secondary striker capture position.

2. The vehicle door latch assembly of claim 1, wherein a primary lug formed on the primary pawl engages a primary closing notch formed on the ratchet when the ratchet is positioned in the primary striker capture position.

3. The vehicle door latch assembly of claim 2, wherein the engagement between the primary lug and the primary closing notch establishes a negative backout relationship between the primary pawl and the ratchet.

4. The vehicle door latch assembly of claim 3, wherein a secondary lug formed on the primary pawl engages a secondary closing notch formed on the ratchet when the ratchet is positioned in the secondary striker capture position.

5. The vehicle door latch assembly of claim 4, wherein the engagement between the secondary lug and the secondary closing notch establishes a neutral backout relationship between the primary pawl and the ratchet.

6. The vehicle door latch assembly of claim 4, further comprising a latch release mechanism operable to initially move the secondary pawl from the engaged position into the disengaged position, and wherein the latch release mechanism is further operable to subsequently move the primary pawl from the engaged position to the disengaged position.

7. The vehicle door latch assembly of claim 1 further comprising:

a ratchet spring for biasing the ratchet toward the striker release position;

a primary pawl spring for biasing the primary pawl toward the engaged position; and a secondary pawl spring for biasing the secondary pawl toward the engaged position.

8. The vehicle door latch assembly of claim 7 further comprising a snow-load lever spring for biasing the snow-load lever toward the engaged position.

9. The vehicle door latch assembly of claim 5, wherein the primary lug on the primary pawl is formed to include an eccentric profile, and wherein the secondary lug on the primary pawl is formed to include a concentric profile.

10. The vehicle door latch assembly of claim 9, wherein the eccentric profile of the primary lug cooperates with the primary closing notch on the ratchet to define the eccentric directional force vector when the ratchet is located in the primary striker capture position, and wherein the secondary lug cooperates with the secondary closing notch on the ratchet to define the concentric directional force vector when the ratchet is located in the secondary striker capture position.

11. A vehicle door latch assembly, comprising:

a single ratchet-double pawl latch mechanism having a ratchet, a primary pawl and a secondary pawl, the ratchet being moveable between a striker release position whereat the ratchet is positioned to receive a striker and primary and secondary striker capture positions whereat the ratchet is positioned to retain the striker, the primary pawl being moveable between an engaged position whereat the primary pawl is positioned to hold the ratchet in one of the primary and secondary striker capture positions and a disengaged position whereat the primary pawl is positioned to permit movement of the ratchet to the striker release position, the secondary pawl being moveable between an engaged position whereat the secondary pawl is positioned to hold the primary pawl in the engaged position and a disengaged position whereat the secondary pawl is positioned to permit the primary pawl to move to the disengaged position; and a latch release mechanism operable for moving the secondary pawl from the engaged position to the disengaged position and for subsequently moving the primary pawl from the engaged position to the disengaged position;

wherein an eccentric directional force vector is established between the ratchet and the primary pawl when the ratchet is located in the primary striker capture position and the primary pawl is located in the engaged position, and wherein a concentric directional force vector is established between the ratchet and the primary pawl when the ratchet is located in the secondary striker capture position and the primary pawl is located in the engaged position.

12. The vehicle door latch assembly of claim 11, wherein a primary lug formed on the primary pawl engages a primary closing notch formed on the ratchet when the ratchet is positioned in the primary striker capture position.

13. The vehicle door latch assembly of claim 12, wherein engagement between the primary lug and the primary closing notch establishes a negative backout relationship between the primary pawl and the ratchet.

14. The vehicle door latch assembly of claim 13, wherein a secondary lug formed on the primary pawl engages a secondary closing notch formed on the ratchet when the ratchet is positioned in the secondary striker capture position.

15. The vehicle door latch assembly of claim 14, wherein engagement between the secondary lug and the secondary closing notch establishes a neutral backout relationship between the primary pawl and the ratchet.

16. The vehicle door latch assembly of claim 15, wherein the primary lug on the primary pawl is formed to include an eccentric profile, and wherein the secondary lug on the primary pawl is formed to include a concentric profile.

17. The vehicle door latch assembly of claim 11 further comprising:

a ratchet spring for biasing the ratchet toward the striker release position;

a primary pawl spring for biasing the primary pawl toward the engaged position; and a secondary pawl spring for biasing the secondary pawl toward the engaged position.

18. The vehicle door latch assembly of claim 11 further comprising:

a ratchet lever coupled for concurrent movement with the ratchet and having a ratchet lever activation segment; and a snow-load lever moveable between a disengaged position whereat the snow-load lever is positioned to permit movement of the secondary pawl between the engaged and disengaged positions and an engaged position whereat the snow-load lever is positioned to hold the secondary pawl in the disengaged position, wherein the ratchet lever activation segment engages and holds the snow-load lever in the disengaged position when the ratchet is located in the primary striker capture position, wherein movement of the ratchet in a releasing direction from the primary striker capture position causes the ratchet lever activation segment to disengage the snow-load lever and permit the snow-load lever to move from the disengaged position into the engaged position, and wherein movement of the ratchet in a closing direction from the secondary striker capture position toward the primary striker capture position causes the ratchet lever activation segment to engage the snow-load lever and cause the snow-load lever to move from the engaged position into the disengaged position.

19. The vehicle door latch assembly of claim 18 further comprising:

a ratchet spring for biasing the ratchet toward the striker release position;

a primary pawl spring for biasing the primary pawl toward the engaged position;

a secondary pawl spring for biasing the secondary pawl toward the engaged position; and a snow-load lever spring for biasing the snow-load lever toward the engaged position.

20. A vehicle door latch assembly, comprising:

a latch mechanism having a ratchet having a primary closing notch and a secondary notch formed thereon, the ratchet being moveable between a striker release position whereat the ratchet is positioned to receive a striker and primary and secondary striker capture positions whereat the ratchet is positioned to retain the striker, a pawl being moveable between an engaged position whereat the pawl is positioned to hold the ratchet in one of the primary and secondary striker capture positions and a disengaged position whereat the pawl is positioned to permit movement of the ratchet to the striker release position, the pawl having a primary lug formed thereon to engage the primary closing notch when the ratchet is positioned in the primary striker capture position, wherein the primary lug is formed to include an eccentric profile, and a secondary lug formed thereon to engage the secondary closing notch when the ratchet is positioned in the secondary striker capture position, wherein the secondary lug is formed to include a concentric profile; and a latch release mechanism operable for moving the pawl from the engaged position to the disengaged position.

21. The vehicle door latch assembly of claim 11, wherein the concentric directional force vector is established between the ratchet and the primary pawl when the primary pawl is located in the engaged position and the secondary pawl is in the disengaged position and the ratchet is located in the secondary striker capture position.

* * * * *